United States Patent [19]

Bowling

[11] Patent Number: 4,970,956

[45] Date of Patent: Nov. 20, 1990

[54] SOLID STATE PROGRAMMABLE INTERVALOMETER

[75] Inventor: John C. Bowling, Maitland, Fla.

[73] Assignee: The United States of America, as represented by the Secretary of the Navy, Washington, D.C.

[21] Appl. No.: 756,586

[22] Filed: Dec. 27, 1976

[51] Int. Cl.[5] ..... F42C 11/06

[52] U.S. Cl. ..... 102/217; 102/419

[58] Field of Search ..... 102/18 R, 16, 14

[56] References Cited

U.S. PATENT DOCUMENTS 3,102,476 9/1963 Naeseth ..... 102/217

3,262,388 7/1966 McCarty ..... 102/217

*Primary Examiner*—David H. Brown

*Attorney, Agent, or Firm*—Harvey David; John Becker; Sol Sheinbein

[57] ABSTRACT

Electronic intervalometer circuitry utilizing a combination of mechanically actuated switches and solid state logic components to carry out a predetermined program of deployment and sequential detonations of a plurality of underwater explosive charges.

8 Claims, 2 Drawing Sheets

SOLID STATE PROGRAMMABLE INTERVALOMETER

BACKGROUND OF THE INVENTION

This invention relates generally to electronic intervalometers, and more particularly to programmable intervalometer circuitry for use in deploying and detonating an array of explosive charges.

Certain military endeavors call for the deployment of an array of underwater explosive charges at a predetermined depth, and sequential detonations of those charges according to a predetermined program. The prior art includes anti-submarine or mine countermining depth charge detonators of at least two types. One that relies on hydrostatic pressure to actuate a mechanical sear to release a firing pin when the charge falls to a predetermined depth, and another that utilizes a timing mechanism or fuze to effect arming followed by detonation at a predetermined interval after dropping, the interval being calculated to result in detonation at a prescribed depth. Those prior art systems, however, are not satisfactory for use where a plurality of cahrges of an explosive array are required to be deployed at an assigned depth and detonated at timed intervals.

SUMMARY OF THE INVENTION

The present invention aims to overcome some or all of the disadvantages of the prior art and to accomplish a number of objects, some of which have not been addressed heretofore.

With the foregoing in mind, it is a principal object of this invention to provide a novel and useful electronic intervalometer device.

Another object is to provide an electronic intervalometer device that is capable of carrying out a predetermined arming, timing, and control program in response to sensing of a selected, predetermined hydrostatic pressure.

Another object is the provision of a novel electronic intervalometer for use in an underwater explosive charge system including a flotation unit, a control unit, a plural charge explosive array, means for paying out cable between the flotation unit and the control unit and array, and means for deploying the array relative to the control unit.

Still another object is the provision of an intervalometer suitable for the above use and which is responsive to hydrostatic pressure at a selected depth to provide control and timing signals for effecting a plurality of operations at appropriately timed intervals, such as cable snubbing, array deployment, sequential detonation of charges, and scuttling of the system.

Yet another object is the provision of an intervalometer of the foregoing character that can be constructed using reliable, compact solid state circuitry operable from a low voltage power source such as a sea water activated battery.

Other objects and many of the attendant advantages will be readily appreciated as the subject invention becomes better understood by reference to the following detailed description, when considered in conjunction with the accompanying drawings.

DESCRIPTION OF THE PREFERRED EMBODIMENT

Figure 1:
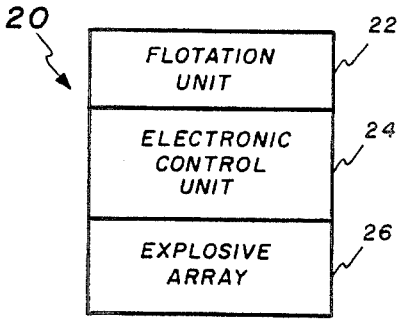
FIG. 1 is a diagrammatic illustration of an explosive charge array system including an electronic control unit comprising an intervalometer circuit embodying the invention.
Figure 2:
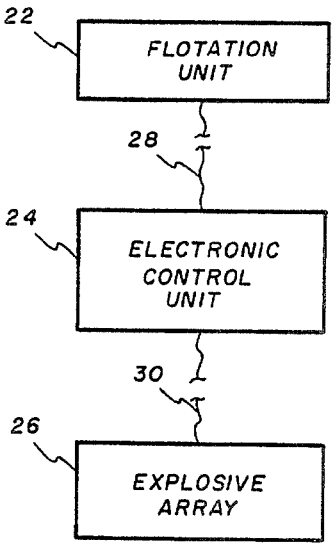
FIG. 2 is a diagrammatic illustration of the system of FIG. 1 shown in operative condition.

Referring to the block diagram of FIG. 1, an underwater explosive charge array system employing the invention is indicated generally at 20 and comprises a flotation unit 22, an electronic control unit 24, and a plural charge explosive array 26. The system 20 is adapted to be released into the water as a package, whereupon the flotation unit separates from the remainder of the system with a cable 28 being paid out therebetween as shown in FIG. 2. When the electronic control unit 24 and explosive array 26 sink to an assigned depth, a pressure responsive portion of the intervalometer circuitry of this invention, forming part of the electronic control unit 24 and described in detail with reference to FIGS. 3*a* and 3*b*, initiates a program of timed control signals for snubbing cable 28, deploying the explosive array, arming the detonating circuitry, effecting successive detonations of the charges, and scuttling of the system. The connections between the electronic control unit 24 and the explosive array are collectively represented by line 30 in FIG. 2.

Figure 3A:
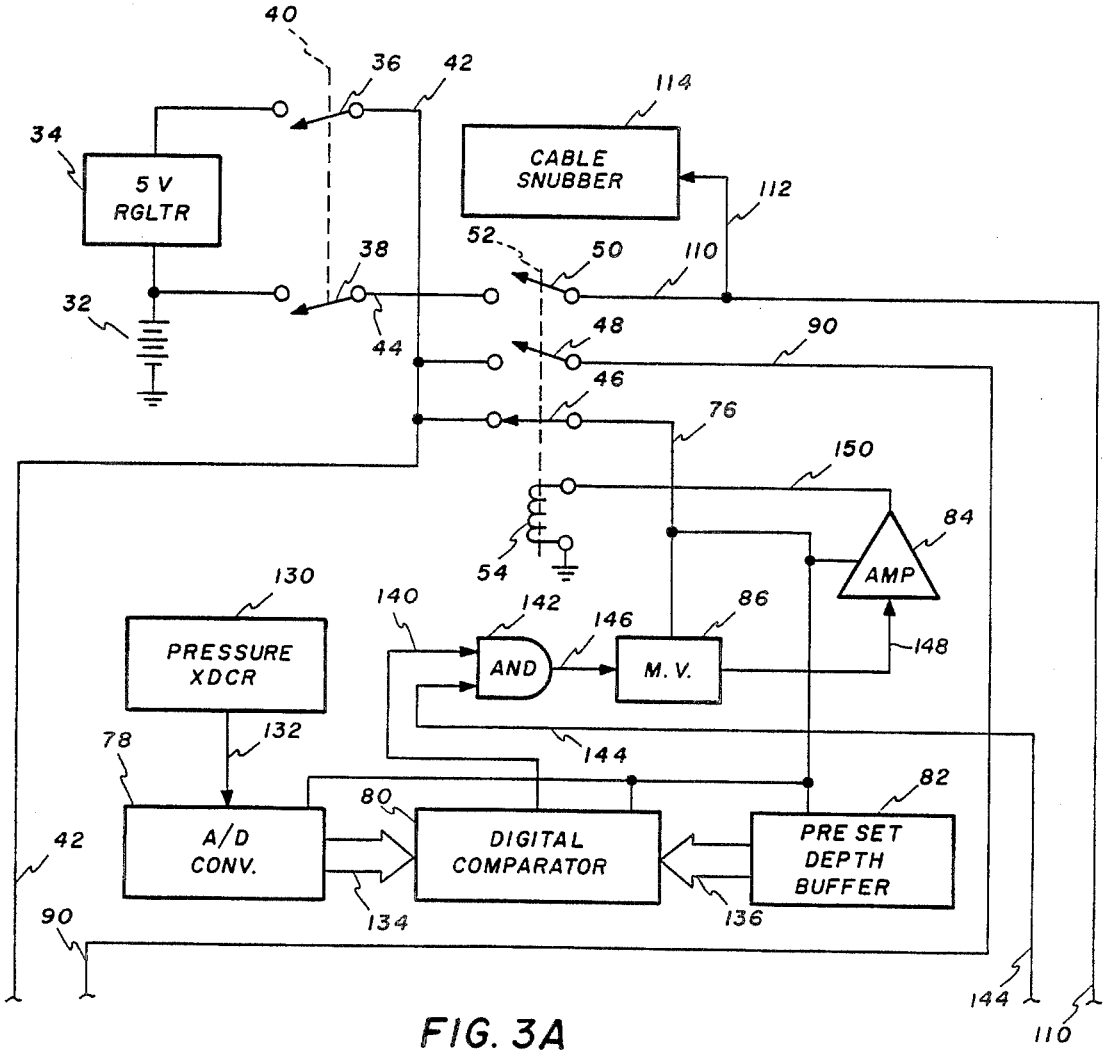
FIGS. 3*a* and 3*b* comprise a diagrammatic illustration, in block form, of the intervalometer circuit forming part of the control unit of FIGS. 1 and 2.
Figure 3B:
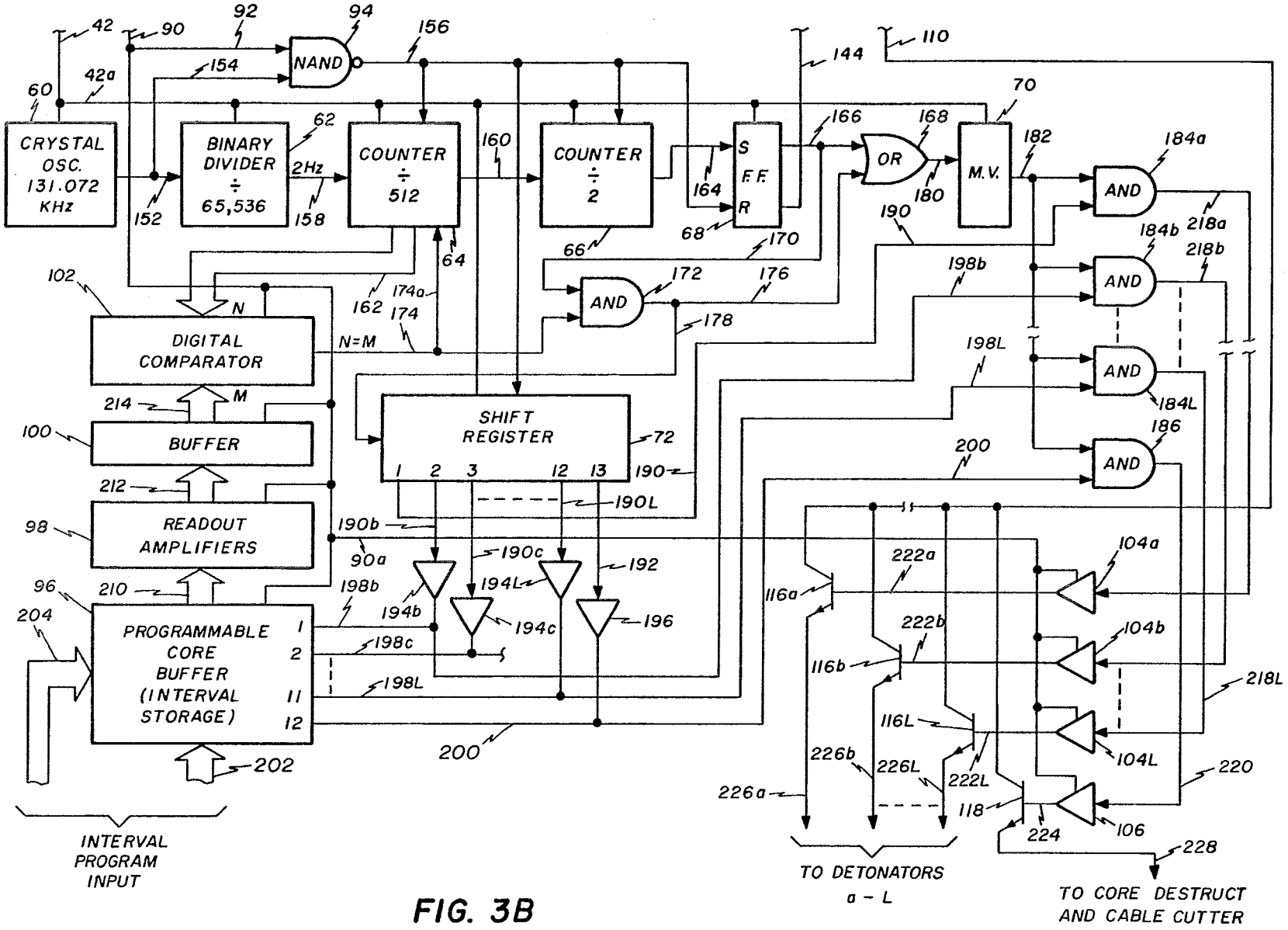

Referring now to FIGS. 3*a* and 3*b*, the intervalometer circuitry comprises a battery 32 as its source of electrical power. The battery is connected through a voltage regulator 34 to one side of a normally open switch 36, and is also connected directly to one side of another normally open switch 38. Switches 36 and 38 are gauged for simultaneous closure, as shown by dotted line 40, in response to separation of the flotation unit 22, for example by withdrawal of a switch actuating pin. Closure of switches 36 and 38 applies electrical voltage to conductors represented by lines 42 and 44, respectively. Line 42 is connected to one side of a normally closed switch 46 and to one side of a normally open switch 48. Line 44 is connected to one side of a normally open switch 50. Switches 46,48, and 50 are conveniently of a pin actuated type, the pin being represented by dotted line 52 and adapted for withdrawal by a solenoid 54. Line 42 is further connected to provide power to a crystal oscillator 60, a binary divider 62, a dividing counter 64, a dividing counter 66, a flip-flop 68, and a multivibrator 70, and a shift register 72.

The normally closed switch 46 is connected as shown by line 76 to provide power to an analog to digital converter 78, a digital comparator 80, a preset depth buffer 82, a solenoid driving amplifier 84, and a multivibrator 86. The normally open switch 48 is connected to provide voltage, when closed, as shown by line 90, to one input 92 of a NAND gate 94, to a programmable core buffer 96, to readout amplifiers 98, a buffer 100, and a digital comparator 102. Line 90 is further connected, as shown by line 90*a*, to provide voltage to a plurality of amplifiers 104*a*, 104*b*–104*l* and 106. The other normally open switch 50 is connected, as shown by lines 110, 112, to an electrically actuable cable snubber 114, to a plurality of switching transistors 116*a*, 116*b*–116*l*, and to a switching transistor 118.

The mentioned depth responsive portion of the intervalometer circuitry comprises a pressure transducer 130 that provides a voltage output that is connected as shown by line 132 to the input of analog to digital converter 78. The output of converter 78 is connected as shown by the broad flow line 134 as one input to the digital comparator 80. This input is a digitized representation of the hydrostatic pressures sensed by transducer 130 as the control unit and array sink. It will be understood that, in the preferred embodiment being described, digital components such as converter 78, comparator 80, and buffer 82 are binary in character and the broad flow lines represent a plurality (e.g., nine) of parallel binary data bits.

A second input is provided to the comparator 80 by the preset depth buffer 82. This input, represented by line 136, is a digitized representation of a selected depth at which a timing and control program is initiated. The output of comparator 80 is applied via line 140 as one input to an AND gate 142. The other input to gate 142 is derived via line 144 from flip-flop 68. The output of gate 142 is connected as a triggering input to multivibrator 86, as shown by line 146. The output of multivibrator 86, line 148, is applied to amplifier 84 which, in turn has its output fed via line 150 to solenoid 54.

The crystal oscillator 60 provides a 131.072 KHz clock frequency that is applied via line 152 to divider 62 and via line 154 to NAND gate 94. The output of that gate, line 156, is connected to the reset inputs of counters 64, 66, flip-flop 68, and the shift register 72. The output of divider 62, which divides by 65,536 and provides a pulse every 0.5 second for a 2 Hz clock signal, is connected by line 158 as input to counter 64. The latter divides by 512 to provide output pulses at 256 second intervals via line 160 to counter 66. As the counter 64 counts up the 2 Hz input, the count is applied as shown by line 162 as one input to digital comparator 102. Counter 66 divides by two so as to provide an output pulse, via line 164, to flip-flop 68 after an 8.53 minute interval. The purposes of the foregoing pulses, counts, and intervals will be made apparent as this description proceeds.

The set output of flip-flop 68 is applied via line 166 as one input to an OR gate 168, and via line 170 as one input to an AND gate 172. AND gate 172 has its second input connected as shown by line 174 to the output of comparator 102, and has its output connected via line 176 as the second input to the OR gate 168 and via line 178 to the shift input of the shift register 72.

The OR gate 168 has its output connected by line 180 to the triggering input of the monostable multivibrator 70, the output of which, on line 182, is connected as shown to one input of each of thirteen AND gates **184*a*, 184*b*–184*l*, and 186. The second inputs to those AND gates are derived from the shift register 72, which in this example comprises thirteen shift stages. The first stage output of shift register 72 is connected directly to an input of AND gate 184*a* as shown by line 190. The remaining twelve stages of shift register 72 are connected as shown by lines 190*b*, 190*c*–190*l*, and 192 to a plurality of twelve amplifiers 194*b*, 194*c*–194*l*, and 196. These amplifiers have their outputs respectively connected via lines 198*b*, 198*c*–198*l*, and 200 to twelve read signal inputs of the programmable core buffer 96 and as the second inputs to each of AND gates 184*b*–184*l*, and 186**.

The buffer 96 is adapted to be programmed, as indicated by lines 202 and 204 to, and selectively read out, appropriate predetermined interval data for detonation of each of the charges in array 26, and for activation of scuttling means including explosive means for destroying the programmable core buffer 96 and cable cutter means for severing cable 28. The digital readout 210 of buffer 96 is fed via readout amplifiers 98 to the buffer 100 as shown by line 212. Buffer 100, holds the readout, reinput 214 to the digital comparator 102.

The AND gates **184*a*, 184*b*–184*l*, and AND gate 186 have their outputs connected respectively as shown by lines 218*a*, 218*b*– 218*l*, and 220 to the corresponding amplifiers 104*a*, 104*b*–104*l*, and 106. These amplifiers are connected, as shown by lines 222*a*, 222*b*–222*l*, and 224, to drive the switching transistors 116*a*, 116*b*–116*l*, and 118 for energizing the explosive array charge detonators via conductors 226*a*, 226*b*–226*l*, and the core destruct and cable cutter means via conductor 228**.

MODE OF OPERATION

Consider the flotation unit 22 to have separated from the electronic control unit 24 and the pin actuated switches 36,38 to have closed. The depth sensing portion of the intervalometer circuitry is thereby conditioned for operation, and the crystal oscillator 60 causes gate 94 to preset the counters 64 and 66, the flip-flop 68, and the shift register 72 to states which insure against a premature or false operation.

As the control unit falls, the output of pressure transducer 130 is digitized and compared in comparator 80 against a digital representation of the predetermined assigned depth preset into depth buffer 82. When the predetermined depth is reached, the comparator 80 provides a signal to AND gate 142 which, in coincidence with the output of flip-flop 68 via line 144, provides a triggering pulse to the multivibrator 86. The resulting multivibrator output causes amplifier 84 to energize solenoid 54 to pull the actuating pin of switches 46,48, and 50.

Switch 46 is thereby opened to deenergized the depth sensing portion of the circuitry. Switch 48 is closed to energize, via lines 90 and **90*a*, the programmable core buffer 96, readout amplifiers 98, buffer 100, comparator 102, amplifiers 104*a*, 104*b*–104*l*, and 106, and as an important function to apply a signal via line 92 to NAND gate 94 that causes it to remove the preset signal from counters 64,66, flip-flop 68 and shift register 72**, freeing them for their respective functions with the counters zeroed and the shift register set with a logical 1 at the first stage and logical 0 at each of the subsequent stages.

Switch 50 is also closed and energizes cable snubber 114 to stop cable 28 from paying out further, thereby terminating the fall of the electronic control unit 24 at the assigned depth, and initiating deployment of the explosive charge array 26. Closing of switch 50 also serves to provide power to the collectors of switching transistors **116*a*, 116*b*–116*l*, and 118**.

The earlier mentioned 8.53 minute interval, which begins with the closing of switch 48, provides a time period for the full deployment of the charge array 26 before detonation of the first of the twelve charges thereof. At the end of that interval flip-flop 68 changes state and provides an output signal to OR gate 168 and to AND gate 172. OR gate 168 triggers multivibrator 70 to provide a momentary binary or logical 1 to each of the AND gates **184*a*, 184*b*–184*l*, and 186. Only AND gate 184*a*, however, has a second binary 1 applied thereto at that time because of the condition of the shift register 72 with a 1 only at the first stage. The resulting output from gate 184*a* is applied to amplifier 104*a*** which causes transistor 116a to pass a current via line 226a to the first of the array charge detonators.

Also at the end of the 8.53 minute interval a binary 1 is placed in the second stage of the shift register, readying the AND gate 184b and causing the programmable core buffer 96 to read out, through amplifiers 98 to buffer 100, a digital representation M of the programmed time interval between detonation of the first and second charges of the array. Note that at this time, the divide by 512 counter 64 is again at zero count. Counter 64 counts up at the 2 Hz input rate thereto, with the count N being compared in comparator 102 with the value M in buffer 100. When N=M comparator 102 produces an output to gate 172 which is passed thereby to gate 168 and as a shift command to register 72 causing it to shift a 1 into the third stage. Gate 168 again triggers multivibrator 70.

Now, only gate 184b is responsive to the multivibrator 70 output because of the logical 1 at stage 2 of the shift register. Accordingly, transistor 116b passes current to the second charge detonator of the array.

The output of the comparator on line 174 is also applied to counter 64 via line 174a to reset it to zero for the upcoming third interval since the second interval required something less than a full count of 512. The placing of a logical 1 into the third stage of register 72 places a corresponding one of the gates 184a, 184b–184lin readiness for detonation of the third charge of the array, and also causes the programmable core buffer 96 to deliver the predetermined interval data M for the third charge to the buffer 100. Counter 64, which has been zeroed, again counts up the value N at the 2 Hz clock rate for comparison with the new value M. When N=M, the comparator output is passed by AND gate 172 and OR gate 168 to trigger the multivibrator 70 and detonate the third charge.

The foregoing cycle of events is repeated until each of the twelve charges of the array are detonated, and then once more, using the 13th stage of register 72, the twelfth interval, programmed into buffer 96, the AND gate 186, amplifier 106, and switching transistor 118 to energize destruction means for the programmable core buffer 96 and the energize cable cutter means for scuttling the electronic control unit 24.

From the foregoing detailed description of an exemplary programmable electronic intervalometer circuitry embodying the invention it will be appreciated that the invention accomplishes the previously stated objects and advantages, as well as others, in a particularly effective manner.

It will also be appreciated that the intervalometer circuitry of this invention, incorporates certain combinations of components, arrangements of parts, and cooperation of elements that render it particularly suited for use in combination with the deployment and detonation of explosive charges.

Obviously, other embodiments and modifications of the subject invention will readily come to the mind of one skilled in the art having the benefit of the teachings presented in the foregoing description and the drawing. It is, therefore, to be understood that this invention is not to be limited thereto and that said modifications and embodiments are intended to be included within the scope of the appended claims.

What is claimed is:

1. An intervalometer device for use in combination with an underwater explosive system comprising a flotation unit, a control unit adapted to fall to a predetermined depth below said flotation unit, and an array of explosive charges adapted to be deployed at said depth for sequential detonation at predetermined intervals, said intervalometer device comprising:

a source of electrical power, depth responsive means, energizeable by said source, for providing a first control signal in response to a predetermined hydrostatic pressure;

first switching means, actuable in response to said first control signal, for energizing fall arresting means and initiating deployment of said array, and for conditioning said circuit to generate timing interval signals and corresponding charge detonating signals;

clock means, connected to said source for generating a train of low frequency clock signals;

counter means, responsive to said clock signals, for providing a first timing interval signal as a first output after a predetermined number of said clock signals, and for providing a second output representative of the instant count N in said counter means;

digital data storage and readout means for storing digital numbers M each corresponding to one of said timing intervals, and for selectively reading out said numbers in response to read signals;

comparison means, coupled to said storage and readout means and to said counter means, for providing a second or subsequent interval signal each time N=M; and logic means, responsive to said timing interval signals, for generating and distributing said read signals to said storage and readout means and charge detonating signals to said explosive charges.

2. An intervalometer device as defined in claim 1, and wherein said logic means comprises:

a flip-flop operable from a first stable condition to a second stable condition in response to actuation of said switch means and operable from said second stable condition to said first stable condition in response to said first interval signal;

OR gate means, responsive to said shifting of said flip-flop to said first stable condition, for providing a first trigger signal corresponding to the end of said first interval;

a shift register having a plurality of binary stages corresponding in number to the number of intervals to be timed and adapted to sequentially change from first to second logic conditions in response to a succession of shift signals;

a plurality of coincidence gate means, each having one input connected to a corresponding one of said shift register stages and an output coupled to a corresponding one of a plurality of second switching means, for distributing said charge detonating signals;

additional coincidence gate means, responsive to one of said conditions of said flip-flop and to said second and subsequent interval signals, for enabling said OR gate means to provide second and subsequent trigger signals corresponding to the ends of second and subsequent intervals, and for providing said succession of shift signals; and monostable multivibrator means, responsive to each of said trigger signals, to provide an input to each of said plurality of coincidence gate means, whereby said charge detonating signals are generated successively, each at the end of one of said intervals and each by a different one of said plurality of second switching means.

3. An intervalometer device as defined in claim 1, and wherein said counter means comprises:

a resetable first counter characterized by a first full count capacity and connected to count said clock signals to provide said second output, said first counter being operative to provide a full count signal each time a full count therein is reached; and a second counter characterized by a second full count capacity and connected to count said full count signals of said first counter, said second counter being operative to provide said first interval signal when said second full count capacity is reached.

4. An intervalometer device as defined in claim 3, and wherein said logic means comprises:

a flip-flop operable from a first stable condition to a second stable condition in response to actuation of said switch means and operable from said second stable condition to said first stable condition in response to said first stable condition in response to said first inverval signal;

OR gate means, responsive to said shifting of said flip-flop to said first stable condition, for providing a first trigger signal corresponding to the end of said first interval;

a shift register having a plurality of binary stages corresponding in number to the number of intervals to be timed and adapted to sequentially change from first to second logic conditions in response to a succession of shift signals;

a plurality of coincidence gate means, each having one input connected to a corresponding one of said shift register stages and an output coupled to a corresponding one of a plurality of second switching means, for distributing said charge detonating signals;

additional coincidence gate means, responsive to one of said conditions of said flip-flop and to said second and subsequent interval signals, for enabling said OR gate means to provide second and subsequent intervals, and for providing said succession of shift signals; and monostable multivibrator means, responsive to each of said trigger signals, to provide an input to each of said plurality of coincidence gate means, whereby said charge detonating signals are generated successively, each at the end of one of said intervals and each by a different one of said plurality of second switching means.

5. An intervalometer device as defined in claim 4, and wherein said first switching means comprises:

a normally closed first switch and normally open second and third switches; and solenoid means, responsive to said first control signal, for actuating said first, second, and third switches to opposite conditions of closure, whereby said depth responsive means is deenergized, electrical power is provided to said plurality of second switching means, and timing of said predetermined intervals is initiated.

6. An intervalometer device as defined in claim 5, wherein each of said plurality of second switching means comprises an amplifier operatively connected to a switching transistor, said switching transistor being responsive to the output of said amplifier to apply electrical power from said third switch to the detonator of one of said charges.

7. An intervalometer device in combination with an underwater explosive charge system including a flotation unit, a control unit adapted to separate from and sink below said flotation unit, cable means interconnecting said flotation and control units, and an array of explosive charges adapted to be deployed from said control unit and to have the charges detonated sequentially at predetermined intervals, said intervalometer device comprising:

a source of electrical power;

mechanically actuable first switch means connected to said source and adapted to close in response to separation of said control unit;

solenoid actuable second switch means connected to said first switch means and comprising a normally closed first switch, a normally open second switch, and a normally open third switch;

a pressure transducer operative to provide an analog output representative of depth of said control unit;

an analog to digital converter connected to the output of said transducer so as to provide a depth representing digital output;

a presettable depth buffer for providing a digital output representing a predetermined depth;

a first digital comparator connected to the outputs of said converter and said depth buffer and operative to provide an output signal when the actual depth equals the predetermined depth;

a first coincidence gate operative to provide a trigger signal as an output in response to coincidence of said output signal of said and another signal as a second input;

a first monostable multivibrator, triggerable by said output of said first coincidence gate, and operative to provide an output pulse;

a driver amplifier connected between said multivibrator and the solenoid of said second switch means and operative in response to said output pulse to change the states of closure of said first, second, and third switches;

said converter, said comparator, said depth buffer, said multivibrator and said driver amplifier being energized upon closure of said first switch means and deenergized upon actuation of said second switch means;

an oscillator operative to provide an output signal characterized by predetermined frequency, said oscillator being energized upon closure of said first switch;

a binary divider operative to reduce said predetermined frequency to provide an output signal characterized by a second predetermined frequency;

a resetable first counter characterized by a first full count and operative to count at said second predetermined frequency so as to provide a first output that is a digital representation of the count therein and a second output each time the count reaches said first full count;

a second counter characterized by a second full count and operative to count the second output occurrences of said first counter so as to provide an output when said second full count is reached;

second coincidence gate means operative to provide a first output condition in response to said output of said oscillator alone and a second output condition in response to coincidence of said oscillator output and closure of said second switch, said first output condition being effective to preset said counters and said second output condition being effective to release said counters to begin counting;

a flip-flop operative to provide a first output corresponding to a reset state induced by said first output condition of said second coincidence gate means, said flip-flop being operative to provide a second output corresponding to a set state induced by said output of said second counter, said first output of said flip-flop comprising said other signal as the second input to said first coincidence gate and said second output of said flip-flop representing the end of a first of said predetermined intervals;

an OR gate responsive to said second output of said flip-flop to provide an output;

a second monostable multivibrator responsive to the output of said OR gate to provide an output;

a shift register having a plurality of binary stages and responsive to sequential occurrences of an input signal to sequentially change states of said stages, a plurality of third coincidence gates each having one input connected to receive the output of said second monostable multivibrator and having a second input coupled to one of said stages of said shift register, each of said third coincidence gates having an output coupled to a charge detonator;

a programmable core buffer having interval data for a plurality of intervals stored in digital form therein and being operative in response to changes of state of said stages to read out corresponding interval data;

a second digital comparator adapted to compare the count in said first counter to interval data read out from said programmable core buffer and to provide an output when said count in said first counter equals the read out data;

a fourth coincidence gate responsive to coincidence of said second output of said flip-flop and said output of said comparator to provide an output as a second input to said OR gate and as said input signal to said shift register, whereby said second multivibrator is triggered to enable one of said third coincidence gates to effect energization of a corresponding charge detonator and said shift register is actuated to change state of a subsequent stage to condition the intervalometer device for energizing a subsequent charge detonator after a subsequent predetermined interval.

8. An intervalometer device as defined in claim 7, and wherein each of said plurality of third coincidence gates is coupled to a corresponding one of a plurality of charge detonators by an amplifier connected in driving relation to a switching transistor, each switching transistor being connected in controlling relation between said third switch and a respective charge detonator.

* * * * *